US007833047B2

(12) United States Patent
Pizzi

(10) Patent No.: US 7,833,047 B2
(45) Date of Patent: Nov. 16, 2010

(54) SPRING PART FOR RETAINING ELECTRIC WIRES AND TERMINAL BLOCK COMPRISING SAID SPRING PART

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 12/423,509

(22) Filed: Apr. 14, 2009

(65) Prior Publication Data

US 2009/0258546 A1 Oct. 15, 2009

(30) Foreign Application Priority Data

Apr. 15, 2008 (IT) ..... MI2008A0673

(51) Int. Cl.
*H01R 9/08* (2006.01)

(52) U.S. Cl. ..... 439/441; 439/410; 439/395

(58) Field of Classification Search ..... 439/441, 439/410, 395
See application file for complete search history.

(56) References Cited

U.S. PATENT DOCUMENTS

| | | | | |
|---|---|---|---|---|
| 945,017 | A | 1/1910 | Cole | |
| 2,045,847 | A | 6/1936 | Fotsch | |
| 2,082,947 | A | 6/1937 | Fotsch | |
| 2,900,618 | A | 8/1959 | Geier | |
| 3,159,730 | A | 12/1964 | Staffel | |
| 3,609,642 | A * | 9/1971 | Norden | 439/441 |
| 3,665,376 | A | 5/1972 | Paris et al. | |
| 3,751,579 | A | 8/1973 | Nojiri | |
| 3,775,733 | A | 11/1973 | Ege | |
| 3,840,781 | A | 10/1974 | Brown | |
| 4,070,086 | A | 1/1978 | Trafford | |
| 4,130,331 | A * | 12/1978 | Neff et al. | 439/396 |
| 4,171,861 | A | 10/1979 | Hohorst | |
| 4,203,200 | A | 5/1980 | Wiebe | |
| 4,224,592 | A | 9/1980 | Urani et al. | |
| 4,241,975 | A | 12/1980 | Cooper, Jr. | |

(Continued)

FOREIGN PATENT DOCUMENTS

| | | | |
|---|---|---|---|
| DE | 3339365 | A1 | 5/1985 |

(Continued)

OTHER PUBLICATIONS

European Search Report from EP08075059, dated, Aug. 24, 2009.

*Primary Examiner*—Truc T Nguyen
(74) *Attorney, Agent, or Firm*—Mintz Levin Cohn Ferris Glovsky and Popeo, P.C.

(57) ABSTRACT

Spring part for retaining wires inside electric terminal blocks, comprising a conductor body substantially in the form of an overturned "U", with a vertical arm substantially parallel to the vertical direction and a second arm forming an acute angle with the vertical arm and having a free end. The two arms being connected together by a convex curved section adapted to produce a resilient reaction of the second arm with respect to the vertical arm. The vertical arm can be joined to a U-shaped base formed from a first vertical arm, connected to the vertical arm of the conductor body, a second vertical arm having a free end and a longitudinal section connecting the two vertical arms. The U-shaped base being designed for stable engagement with a conducting part of the electric terminal block.

17 Claims, 2 Drawing Sheets

U.S. PATENT DOCUMENTS

| | | | | | |
|---|---|---|---|---|---|
| 4,330,164 | A | * | 5/1982 | Pittman et al. | 439/293 |
| 4,340,270 | A | | 7/1982 | Wilmes et al. | |
| 4,350,407 | A | | 9/1982 | Tong | |
| 4,365,396 | A | | 12/1982 | Baba et al. | |
| 4,391,485 | A | | 7/1983 | Urani | |
| 4,444,455 | A | * | 4/1984 | Wiancko et al. | 439/638 |
| 4,559,504 | A | | 12/1985 | Krec | |
| 4,693,533 | A | * | 9/1987 | Szczesny et al. | 439/350 |
| 4,795,997 | A | | 1/1989 | Fisher et al. | |
| 4,889,504 | A | | 12/1989 | Barbier et al. | |
| 4,921,450 | A | | 5/1990 | Herbert | |
| 4,940,431 | A | | 7/1990 | Hennemann | |
| 5,002,505 | A | | 3/1991 | Jones et al. | |
| 5,030,131 | A | | 7/1991 | Boehm | |
| 5,243,139 | A | | 9/1993 | Law | |
| 5,276,280 | A | | 1/1994 | Ball | |
| 5,328,392 | A | | 7/1994 | Lin et al. | |
| 5,454,730 | A | * | 10/1995 | Tozuka | 439/438 |
| 5,553,787 | A | | 9/1996 | Guginsky | |
| 5,564,941 | A | * | 10/1996 | Norden | 439/410 |
| 5,766,044 | A | | 6/1998 | Norden | |
| 5,853,304 | A | | 12/1998 | Landreau et al. | |
| 5,860,837 | A | | 1/1999 | Bock et al. | |
| 5,905,230 | A | | 5/1999 | Marik | |
| 5,915,998 | A | | 6/1999 | Stidham et al. | |
| 6,004,167 | A | | 12/1999 | Hirakawa | |
| 6,157,287 | A | | 12/2000 | Douglass et al. | |
| 6,475,038 | B1 | | 11/2002 | Franck | |
| 6,786,779 | B2 | | 9/2004 | Feldmeier et al. | |
| 7,101,231 | B2 | | 9/2006 | Prokup et al. | |
| 7,385,518 | B2 | | 6/2008 | Torrez et al. | |
| 7,413,486 | B2 | | 8/2008 | Pizzi | |
| 7,438,606 | B2 | | 10/2008 | Pizzi | |
| 7,500,889 | B2 | | 3/2009 | Pizzi | |
| 2002/0067279 | A1 | | 6/2002 | Torrez et al. | |
| 2005/0042912 | A1 | | 2/2005 | Drewes et al. | |
| 2005/0221665 | A1 | | 10/2005 | Otto et al. | |
| 2006/0128232 | A1 | | 6/2006 | Kim | |
| 2006/0148302 | A1 | | 7/2006 | Patel et al. | |
| 2006/0189222 | A1 | | 8/2006 | Bogiel et al. | |
| 2006/0228950 | A1 | | 10/2006 | Jamaleddin et al. | |
| 2007/0159292 | A1 | | 7/2007 | Chang et al. | |
| 2008/0242150 | A1 | | 10/2008 | Chikamatsu et al. | |

FOREIGN PATENT DOCUMENTS

| | | | |
|---|---|---|---|
| DE | 3621071 | A1 | 1/1987 |
| DE | 3629796 | C1 | 12/1987 |
| DE | 3805158 | A1 | 8/1989 |
| DE | 4223540 | A1 | 1/1994 |
| DE | 4409612 | A1 | 9/1994 |
| DE | 19530947 | A1 | 1/1997 |
| DE | 19542628 | C1 | 2/1997 |
| DE | 19729327 | C1 | 10/1998 |
| DE | 29821558 | U1 | 3/1999 |
| DE | 29921080 | | 4/2001 |
| DE | 10010719 | C1 | 8/2001 |
| DE | 10324144 | A1 | 2/2005 |
| DE | 102004018553 | A1 | 11/2005 |
| EP | 0382999 | | 8/1990 |
| EP | 0678934 | A1 | 10/1995 |
| EP | 0893859 | A2 | 1/1999 |
| EP | 1137034 | A1 | 9/2001 |
| EP | 1137035 | A1 | 9/2001 |
| EP | 1381068 | A1 | 1/2004 |
| EP | 1531522 | A1 | 5/2005 |
| EP | 1630903 | A1 | 3/2006 |
| EP | 1798821 | A2 | 6/2007 |
| EP | 1860738 | A1 | 11/2007 |
| FR | 2259462 | A1 | 8/1975 |
| FR | 2529024 | A1 | 12/1983 |
| FR | 2637740 | A1 | 4/1990 |
| FR | 2766628 | A1 | 1/1999 |
| GB | 2342508 | A | 4/2000 |

* cited by examiner

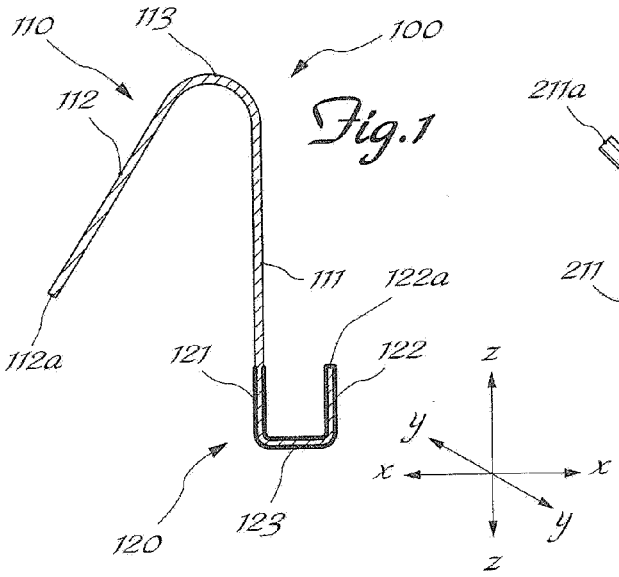
Fig.1
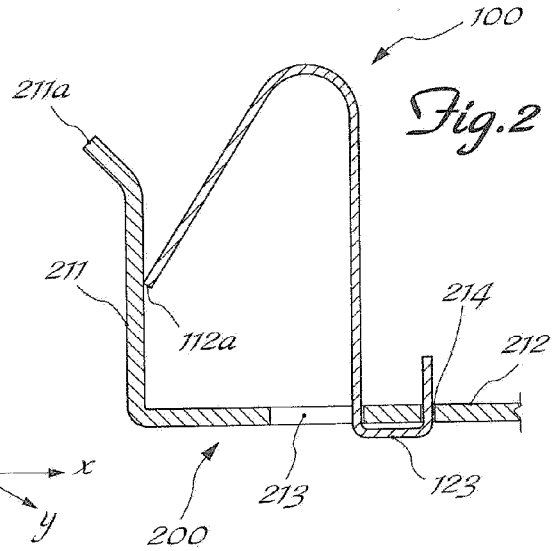
Fig.2
Fig.2a
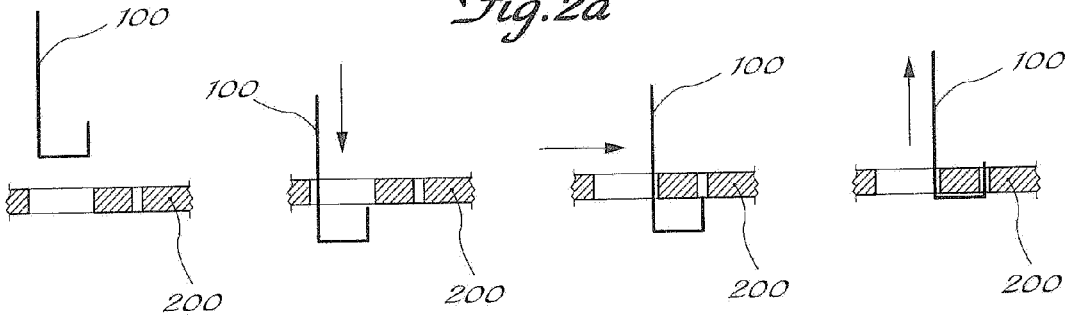
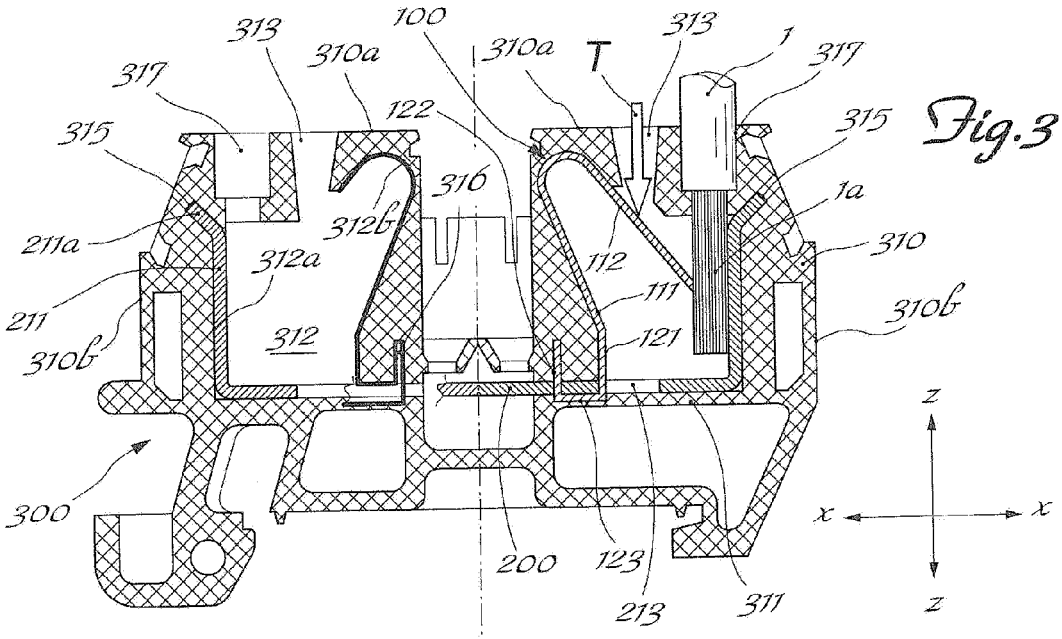
Fig.3

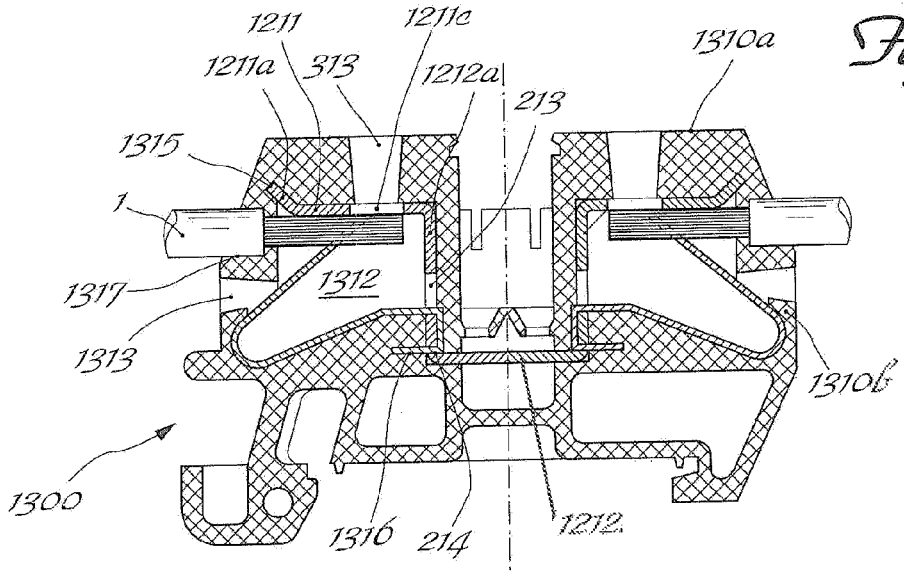
Fig.4
Fig.5
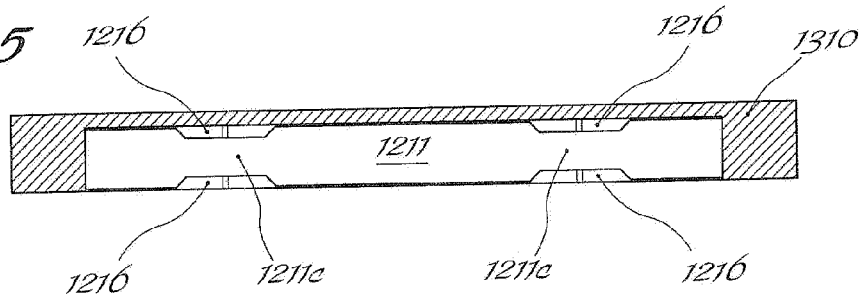
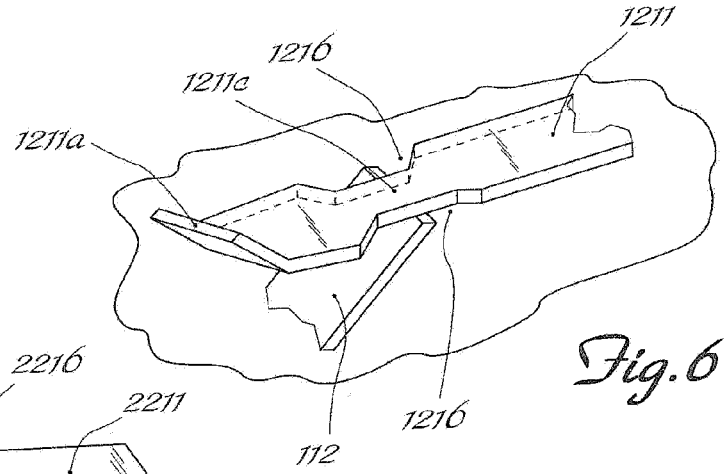
Fig.6
Fig.7
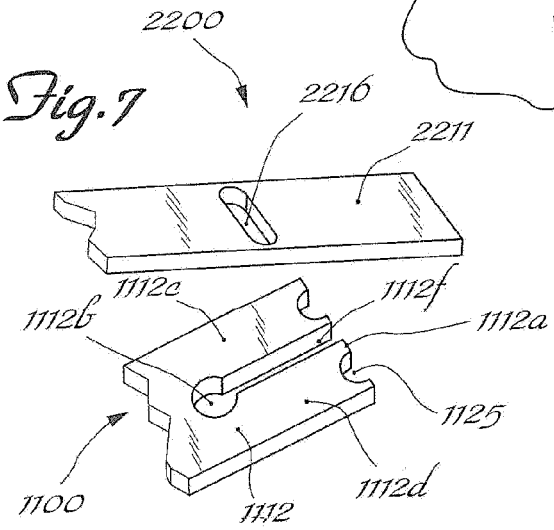

SPRING PART FOR RETAINING ELECTRIC WIRES AND TERMINAL BLOCK COMPRISING SAID SPRING PART

DESCRIPTION

1 Technical Field of the Invention

The present invention relates to a unidirectional spring part for retaining electric wires inside electrical connection terminal blocks and a terminal block comprising the spring.

2 Description of the Prior Art

It is known, in the technical sector relating to electrical connection devices such as terminal strips, connection boxes and the like, to use terminal blocks designed to be mounted on corresponding supports and provide frontal access to the means—normally of the screw type—for retaining the electrical connection wires which form the electric circuit.

It is also known that said means for retaining the end of the electric wire are normally designed with so-called sliders, movable in a direction perpendicular to the direction in which the wire is inserted, upon tightening a screw which causes retraction of the slider so as to grip the wire between the said slider and a counter plate extending parallel to the wire and designed to ensure the electrical continuity of the circuit inside the device.

As an alternative to said screw-operated sliders also known are wire clamping parts formed by a spring plate which is compressively deformed so as to allow opening of a slit and insertion of the wire inside its seat; once insertion has been completed the plate is released and, returning resiliently into the rest condition, ensures clamping of the wire against the counter plate and the electrical connection.

Although fulfilling their function, these known clamping means nevertheless have drawbacks which in the case of a screw-operated slider essentially are due to: the presence of the screw itself which tends to become loose over time, thus no longer ensuring the necessary clamping of the wire, and the fact that the said wire is clamped between two flat surfaces with complex forms which are difficult to produce, resulting in unevenness unable to ensure full electrical contact between wire and terminal block.

In the case of the spring, instead, the drawback is associated with the resilient force which must be imparted to the plate in order to ensure adequate clamping of the wire, which resilient force must be increased with an increase in the electrical loads and therefore the cross-section of the wire to be retained; in terminal blocks of the known type the resilient retaining means consist of parts constrained to supports by means of welds, rivets and the like, which complicate assembly and substantially reduce the possibility of adjusting the resilient force to be applied.

SUMMARY

The technical problem which is posed, therefore, is to provide a spring part for retaining electric wires, in particular for use inside connection devices such as terminal blocks, connection boxes, wired-circuit switchboards and the like, which has small overall dimensions, but at the same time is able to withstand a high electrical load and which, in addition to facilitating assembly, also facilitates adjustment of the force to be imparted depending on the cross-section of the wire to be retained.

In connection with this problem it is also desirable that this retaining part should be easy and inexpensive to produce, be able to be used equally well with different types of electrical connection devices and be able to be easily operated by any user using normal standard tools.

These results are achieved according to the present invention by a unidirectional spring part for retaining electric wires inside electrical connection terminal blocks according to the characteristic features of the invention and a terminal block comprising said spring part according to the characteristic features of the invention.

BRIEF DESCRIPTION OF THE FIGURES

Further details may be obtained from the following description of a non-limiting example of embodiment of the subject of the present invention provided with reference to the accompanying drawings in which:

FIG. 1 shows a schematic cross-section along a longitudinal vertical plane of the spring part according to the present invention;

FIG. 2 shows a schematic cross-section along a longitudinal vertical plane of the spring part according to FIG. 1 mounted on the electrical connection plate of a terminal block;

FIG. 2*a* shows a schematic view of the spring/plate engaging sequence;

FIG. 3 shows a schematic cross-section along a vertical plane of a first embodiment of a terminal block with spring part according to the present invention;

FIG. 4 shows a schematic cross-section along a vertical plane of a second embodiment of the terminal block according to FIG. 3;

FIG. 5 shows a partial top view of the terminal block according to FIG. 4;

FIG. 6 shows a schematic partial perspective view of the spring part plus the electrical connection plate of the terminal block according to FIG. 4; and FIG. 7 shows a partial schematic perspective view of a number of the variation of embodiments of the spring and the contact plate according to the present invention.

DETAILED DESCRIPTION

As shown in FIG. 1 and assuming solely for the sake of simplification of the description and without a limiting meaning a set of three reference axes in the longitudinal direction X-X, transverse direction Y-Y and vertical direction Z-Z, respectively, the spring part 100 for retaining electric wires 1 according to the present invention comprises a conducting body 110 substantially in the form of an overturned "U", with one arm 111 substantially parallel to the vertical direction Z-Z and one arm 112 forming an acute angle with the vertical arm 111 and having a free end 112*a*; the two arms 111,112 are connected together by a convex curved section 113 so as to produce the resilient reaction of the second or inclined arm 112 with respect to the vertical arm 111.

The vertical arm 111 can be joined to a U-shaped base 120 comprising: a first vertical arm 121 for connection to the vertical arm 111, a second vertical arm 122 with a free end 122*a* and a straight section 123 connecting together the two vertical arms.

With this configuration of the spring part 100 it is possible to perform simple and rapid engagement thereof with the electrical connection conductor or plate 200 (FIG. 2) of a terminal block 300 described below (FIG. 3).

The electrical connection plate 200 can have a U-shaped form with substantially vertical arms 211 and a horizontal connecting section 212. The horizontal connecting section 212 can include an eyelet 213 with a longitudinal dimension greater than the longitudinal dimension of the base 120 of the spring 100 and a hole 214 with a longitudinal dimension slightly greater than the width, in the longitudinal direction, of the arm 122 of the base 120 of the spring 100 so that the second vertical arm 122 of the base 120 can be inserted in the hold 214.

In one embodiment of the invention, the hole 214 can be arranged at a distance from the edge of the eyelet 230 substantially coinciding with the length, in the longitudinal direction, of the longitudinal section 123 of the base of the spring so that, when the vertical arm 122 of the base 120 is inserted inside the hole 214 in the sequence schematically shown in FIG. 2*a,* the other vertical arm 121 of the base bears against the inner edge of the eyelet 213 and the spring 100 is firmly secured to the electrical connection plate 200.

In the position where the spring 100 is secured to the plate 200, the free end 112*a* of the arm 112 of the spring itself bears against the vertical arm 211 of the plate 200 against which it presses with a pre-tensioning force determined by the size of the spring.

In accordance with one embodiment of the invention, the free end 211*a* of the vertical arms 211 of the plate 200 can be bent outwards at an obtuse angle so as to form a tooth which can be inserted inside a corresponding seat 315 of a terminal block 300, as will appear more clearly below.

With this embodiment of the retaining spring part and the electrical connection plate it is possible to provide a terminal block 300 according to the present invention which comprises an insulating body 310 forming the container for the conducting part 200 with which the spring 100 provides means for retaining the free end 1*a* of the electric wire 1 are associated.

In greater detail, said insulating body 310 has a frame formed so as to define at least one front side 310*a* and at least two respective sides 310*b* situated opposite each other.

The insulating body 310 can include, formed inside it:

a first pair of seats 312 which are open in the transverse direction Y-Y and symmetrical with respect to a central axis parallel to the vertical direction Z-Z and which have a substantially vertical outer side 312*a* and an inner side 312*b* shaped so as to match the profile of the spring part 100; and, a second pair of seats 315 respectively arranged on opposite sides of the seats 312 towards the sides 310*b* and in turn symmetrical with respect to the axis Z-Z and designed to seat the free inclined end 211*a* of the arm 211 of the contact plate 200, so as to ensure stable retention of the conducting part 200 on the insulating body 310.

The front wall 310*a* of the insulating body 310 can be provided with:

a second pair of substantially vertical seats 316 close to the vertical axis of symmetry and with dimensions corresponding to the arm 122 of the base 120 of the spring 100 and designed to seat said arm when the terminal block is assembled;

a pair of first openings 313 extending in the vertical direction Z-Z, substantially arranged above the respective seat 312 and designed to connect the latter with exterior so as to allow insertion of a tool T; and, a pair of holes 317 with a vertical axis Z-Z, arranged in a position situated further outwards than said first openings 313 and connected to the respective seat 312 with which they communicate for insertion of the bare wire 1*a* in the vertical direction Z-Z.

As shown in the two halves of FIG. 3 the terminal block 300 is assembled as follows:

removing the front cover which is identical to and arranged opposite the frame 311 and is therefore not shown, inserting, in the transverse direction Y-Y, the conducting part 200 already engaged with the spring 100, so that the inclined end 211*a*, the spring means 100 for retaining the wire 1 and the vertical arm 122 of the base 120 are arranged inside the respective seats 315, 312, 316;

the cover is closed;

inserting the tool T inside the hole 313 so as to act on the arm 112 of the spring 100 and pushing it so as to free the end 112*a* from the vertical arm 211 of the electrical conductor 200;

inserting the wire 1 inside the respective entry seat 317 so that the bare end 1*a* penetrates toward the bottom of the seat 312;

extracting the tool, thus releasing the resilient arm 112 of the spring 100 so that it clamps the wire and tightly presses it against the vertical arm 211 of the conductor 200.

As shown in FIG. 4, a version of the terminal block 1300 suitable for insertion of the wires 1 in the longitudinal direction according to an alternate embodiment of the invention.

In this embodiment, the seat 1312 is rotated through 90° outwards and the holes 1317 for insertion of the wire 1 and 1313 for insertion of the tool T have a longitudinal axis X-X, being formed in the sides 1310*b* of the terminal block 1300.

The electrical connection part 1200 has a straight longitudinal section 1212 which is bent at 90° in the vertical direction Z-Z so as to form:

a vertical arm 1212*a* in which the eyelet 213 and the hole 214 are formed and a horizontal arm 1211 with the end 1211*a* bent at an obtuse angle for insertion inside the respective seat 1315.

The horizontal arm 1211 of the conductor 1200 can also have (FIGS. 5, 6) inset zones 1216 designed to form a section 1211*c* of the arm which has a width in the transverse direction Y-Y smaller than the rest of the conductor; this allows a tool T to reach the resilient arm 112 of the spring to operate it via the hole 313 with a vertical axis Z-Z used for the terminal block with vertical insertion of the wire, while the wire 1*a* is inserted in the longitudinal direction X-X through the respective entry hole 1317.

Correspondingly, the spring 100 is rotated through 90° towards the sides 1310*b* of the terminal block so that the resilient arm 112 presses against the horizontal arm 1211 of the conductor 1200.

Assembly and operation of the terminal block are entirely similar to that already described in connection with FIG. 2.

FIG. 7 shows alternative embodiments of the spring 1100 and the plate 2200.

In detail, the spring 1100 has an end part of the arm 1112 which has a cut 1112*f* in the longitudinal direction terminating in a through-hole 1112*b* so as to divide said end part of the arm into two strips 1112*c* and 1112*d* which are independent of each other and have identical resilient properties owing to the hole 1112*b*; with this solution it is therefore possible to insert and retain two wires instead of one, which may also have a different cross-section, against the contact plate 200; 1200.

Advantageously the free end 1112*a* of each strip has an incision 1125 suitable for receiving partially the end 1*a* of the wire 1 and facilitating the insertion thereof without any obstacles and retention thereof in position.

In one embodiment of the invention, the contact plate 2200 can include an arm 2211 with a transverse eyelet 2216 situated opposite the entry hole 313 in the insulating body of the terminal block and designed to allow the insertion of the tool T for actuating the arm of the spring 100,1100.

It is therefore clear how the spring according to the present invention can be quickly and easily engaged with the conducting part of a terminal block for electric cables.

In addition, the particular form of the spring and the engaged arrangement of the spring and conductor result in a substantially unidirectional terminal block in the sense that, once the wire has been inserted, it is prevented from coming out by the free end of the resilient arm of the spring which reacts with greater force the more the wire is pulled outwards.

In addition, it is possible to use the same terminal block for a wide range of wires of varying cross-section, also for high electrical loads, since there are no physical and/or geometrical constraints as regards the conductor cross-section which may be used, it being possible in particular to make use of the entire width, in the transverse direction, of the arm 112;1112 of the spring 100;1100 for ensuring the electrical contact with the plate 200;1200;2200.

It is also clear how, as a result of the particular symmetrical form of the conducting part and the spring, it is possible to reduce the number of parts to be produced and stored since the same component may be equally well used for a right-hand or left-hand design merely by means of correct positioning inside the insulating body of the terminal block.

The invention claimed is:

1. An electric terminal block for connecting wires comprising an insulating body which has, formed therein, a first pair of seats open in a transverse direction and symmetrical with respect to a central axis of symmetry parallel to a vertical direction, an electrical connection conductor and at least one spring part adapted for retaining wires against the electrical connection conductor, wherein, the electrical connection conductor is formed by a U-shaped plate having a first vertical conductor arm and a second vertical conductor arm and the spring part includes a conducting body substantially in the form of an overturned "U" with a vertical arm substantially parallel to the vertical direction and a second arm forming an acute angle with the vertical arm and having a free end, the two arms being connected by a convex curved section adapted to produce a resilient reaction of the second arm with respect to the vertical arm, wherein, the vertical arm is joined to a U-shaped base having a first vertical arm for connection to the vertical arm of the body, a second vertical arm having a free end and a longitudinal section connecting together the first vertical arm and the second vertical arm of the U-shaped base, the U-shaped base being adapted to engage the conducting part and the terminal block, the terminal block having at least one seat close to the central axis of symmetry with dimensions corresponding to the arm of the base of the spring part and able to allow seating and retention of the spring part when the spring part is assembled in terminal block.

2. An electric terminal block according to claim 1, wherein each of the first pair of seats have at least one straight side and at least one side shaped to match a profile of the spring part.

3. An electric terminal block according to claim 1, wherein the insulating body includes a second pair of seats symmetrical with respect to the central axis and each being arranged on opposite sides of the first pair of seats adjacent to one side of the insulating body, each the second pair of seats being adapted to receive and to seat a free end of each of the first vertical conductor arm and the second vertical conductor arm of the conducting part to retain the free end within the insulating body.

4. An electric terminal block according to claim 1, wherein the insulating body includes a pair of holes formed in a front wall of the insulating body and adapted to receive a wire inserted into the terminal block in the vertical direction.

5. An electric terminal block according to claim 1, wherein the electrical connection conductor includes an eyelet with a longitudinal dimension greater than a longitudinal dimension of the U-shaped base of the spring part, a hole having an opening size sufficient to receive the second vertical arm of the base of the spring, said hole being located at a distance from an edge of the eyelet substantially coinciding with the length of the longitudinal section of the U-shaped base of the spring.

6. An electric terminal block according to claim 5, wherein each of the first pair of seats have an outer vertical side substantially parallel to the central axis and an inner vertical side shaped so as to match a profile of the spring part.

7. An electric terminal block according to claim 5, wherein the seat housing the vertical arm of the U-shaped base of the spring extends in the vertical direction.

8. An electric terminal block according to claim 5, wherein insulating body includes a pair of first openings extending in the vertical direction, substantially arranged above the respective seat and adapted to allow insertion of a tool to engage the spring.

9. An electric terminal block according to claim 5, wherein the electrical connection conductor includes a horizontal connecting section in which said eyelet and said hole are symmetrically formed.

10. An electric terminal block according to claim 9, wherein the free end of each of the first vertical conductor arm and the second vertical conductor arm of the electrical connection conductor is bent outwards at an obtuse angle so as to form a contact tooth suitable for engagement with said seats.

11. An electric terminal block according to claim 1, wherein each of first pair of seats has an upper side substantially parallel to a longitudinal direction and a bottom side shaped so as to match a profile of the spring part.

12. An electric terminal block according to claim 11, wherein that the electrical connection conductor includes a horizontal section bent at substantially 90° in the vertical direction so as to form a vertical arm and the vertical arm includes a substantially 90° bend to form a horizontal arm.

13. An electric terminal block according to claim 11, wherein the eyelet and said hole are arranged in the vertical direction.

14. An electric terminal block according to claim 11, wherein the arm has a transverse eyelet situated opposite the entry hole in the insulating body of the terminal block.

15. An electric terminal block according to claim 12, wherein the end of the horizontal arm is bent at an obtuse angle towards a front surface of the insulating body so as to form a contact tooth.

16. An electric terminal block according to claim 11, wherein the electrical connection conductor has inset zones adapted to define a section of the arm having a width in the transverse direction smaller than an adjacent portion of the electrical connection conductor.

17. An electric terminal block according to claim 11, wherein the insulating body includes a pair of holes extending substantially along a longitudinal axis adapted to receive a wire inserted into the terminal block in the said longitudinal direction and formed in a side wall of the insulating body.

* * * * *